US010866553B1

(12) United States Patent
Izumi

(10) Patent No.: US 10,866,553 B1
(45) Date of Patent: Dec. 15, 2020

(54) IMAGE FORMING APPARATUS, DETERMINATION METHOD, AND DEVELOPER PROCESSING APPARATUS CONFIGURED TO DETERMINE TIMING FOR REPLACEMENT OF DEVELOPER BASED ON A HISTORY OF A DETERIORATION INDEX

(71) Applicant: TOSHIBA TEC KABUSHIKI KAISHA, Tokyo (JP)

(72) Inventor: Takao Izumi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/813,920

(22) Filed: Mar. 10, 2020

(51) Int. Cl.
*G03G 15/08* (2006.01)
*G03G 15/00* (2006.01)

(52) U.S. Cl.
CPC ..... *G03G 15/553* (2013.01)

(58) Field of Classification Search
CPC ..... G03G 15/0824; G03G 15/0848; G03G 15/0849; G03G 15/553; G03G 15/556
USPC ..... 399/29
See application file for complete search history.

(56) References Cited

U.S. PATENT DOCUMENTS 5,162,849 A * 11/1992 Yoshino et al. ... G03G 15/0849 399/29
8,213,812 B2 7/2012 Izumi et al.
2015/0177646 A1* 6/2015 Yamada et al. ..... G03G 15/556 399/29

* cited by examiner

*Primary Examiner* — William J Royer
(74) *Attorney, Agent, or Firm* — Amin, Turocy & Watson, LLP

(57) ABSTRACT

An image forming apparatus includes a developing device, a developer container, and a controller. The developing device contains developer including toner and a carrier and includes a stirrer for stirring the developer. The developer container contains the developer to be supplied to the developing device. The controller acquires a deterioration index indicating a degree of deterioration of the developer in the developing device based on stirring cumulative information which is information relating to a cumulative value of time for which the stirrer stirs the developer in the developing device and supply cumulative information indicating information relating to a cumulative value of the developer supplied from the developer container to the developing device, and determines a timing at which the developer needs to be replaced based on information on history of the deterioration index.

20 Claims, 7 Drawing Sheets

IMAGE FORMING APPARATUS, DETERMINATION METHOD, AND DEVELOPER PROCESSING APPARATUS CONFIGURED TO DETERMINE TIMING FOR REPLACEMENT OF DEVELOPER BASED ON A HISTORY OF A DETERIORATION INDEX

FIELD

Embodiments described herein relate generally to an image forming apparatus, a determination method and a developer processing apparatus.

BACKGROUND

In the related art, a technique is known that the performance of developer in a developing device is maintained by supplying new developer to the developing device and discharging old developer from the developing device. Also, a technique is known that a small amount of a carrier (for example, a magnetic substance) is mixed into a cartridge containing toner to be supplied to a developing device to supply the carrier together with the toner. In such techniques, supplying or discharging of the carrier into or from the developing device is performed together with supplying of the toner to the developing device. Therefore, if the supply amount of toner is small, the carrier in the developing device is hardly replaced. That is, if a printing rate of an output image is low, the carrier is hardly supplied, and the carrier in the developing device is not sufficiently replaced. There is a problem in that, if the carrier in the developing device is not sufficiently replaced, the developer deteriorates, thereby causing an image defect.

DETAILED DESCRIPTION

In general, according to one embodiment, an image forming apparatus includes a developing device, a developer container, and a controller. The developing device contains developer including toner and a carrier, and includes a stirrer for stirring the developer. The developer container contains the developer to be supplied to the developing device. The controller acquires a deterioration index indicating a degree of deterioration of the developer in the developing device based on stirring cumulative information which is information relating to a cumulative value of time for which the stirrer stirs the developer in the developing device and supply cumulative information indicating information relating to a cumulative value of the developer supplied from the developer container to the developing device, and determines a timing at which the developer needs to be replaced based on information on history of the deterioration index.

Figure 1:
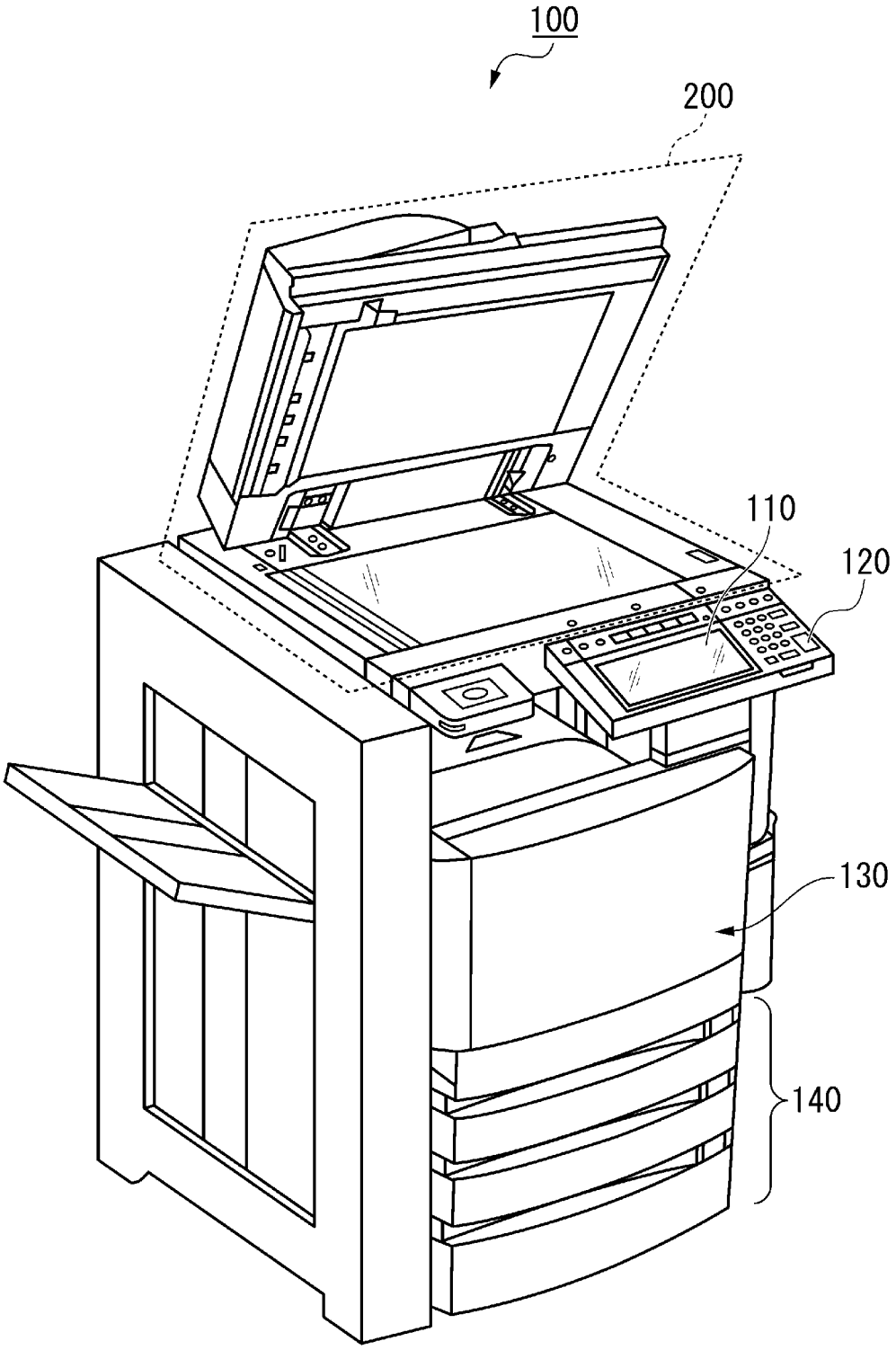
FIG. 1 is an external view illustrating the entire configuration example of an image forming apparatus of an exemplary embodiment.

FIG. 1 is an external view illustrating the entire configuration example of an image forming apparatus 100 of the exemplary embodiment. For example, the image forming apparatus 100 is a multifunction printer. The image forming apparatus 100 includes a display 110, a control panel 120, an image forming unit 130, a sheet containing unit 140, and an image reading unit 200. A developer cartridge is mounted on the image forming apparatus 100. The developer cartridge may be filled with decolorable toner that can be decolored later or may be filled with toner that cannot be decolored later.

The image forming apparatus 100 forms an image on a sheet using toner. For example, the sheet may be paper or label paper. Any material may be used as the sheet, as long as the image forming apparatus 100 can form an image on the surface thereof.

The display 110 is an image display device such as a liquid crystal display, an organic electro luminescence (EL) display, or the like. The display 110 displays various kinds of information relating to the image forming apparatus 100.

The control panel 120 includes a plurality of buttons. The control panel 120 receives an operation of a user. The control panel 120 outputs a signal corresponding to the operation performed by the user to a controller 160 of the image forming apparatus 100. The display 110 and the control panel 120 may be configured as an integrated touch panel.

The image forming unit 130 forms an image on the sheet based on image information generated by the image reading unit 200 or image information received via a communication path. For example, the image forming unit 130 forms an image by the following processing. The image forming unit 130 forms an electrostatic latent image on a photoconductor drum based on the image information. The image forming unit 130 forms a visible image by causing toner to be attached to the electrostatic latent image. Specific examples of the toner include decolorable toner, non-decolorable toner (general toner), decorative toner, and the like. Some toners have a feature that colors thereof fade (disappear) due to heating.

The image forming unit 130 transfers the visible image onto a sheet. The image forming unit 130 fixes the visible image on the sheet by applying heat and pressure to the sheet. The sheet on which the image is formed may be a sheet contained in the sheet containing unit 140 or may be a manually-fed sheet.

The image reading unit 200 reads image information to be read based on brightness and darkness. The image reading unit 200 records the read image information. The recorded image information may be transmitted to another information processing device via a network. The recorded image information may be formed on the sheet as an image by the image forming unit 130.

Figure 2:
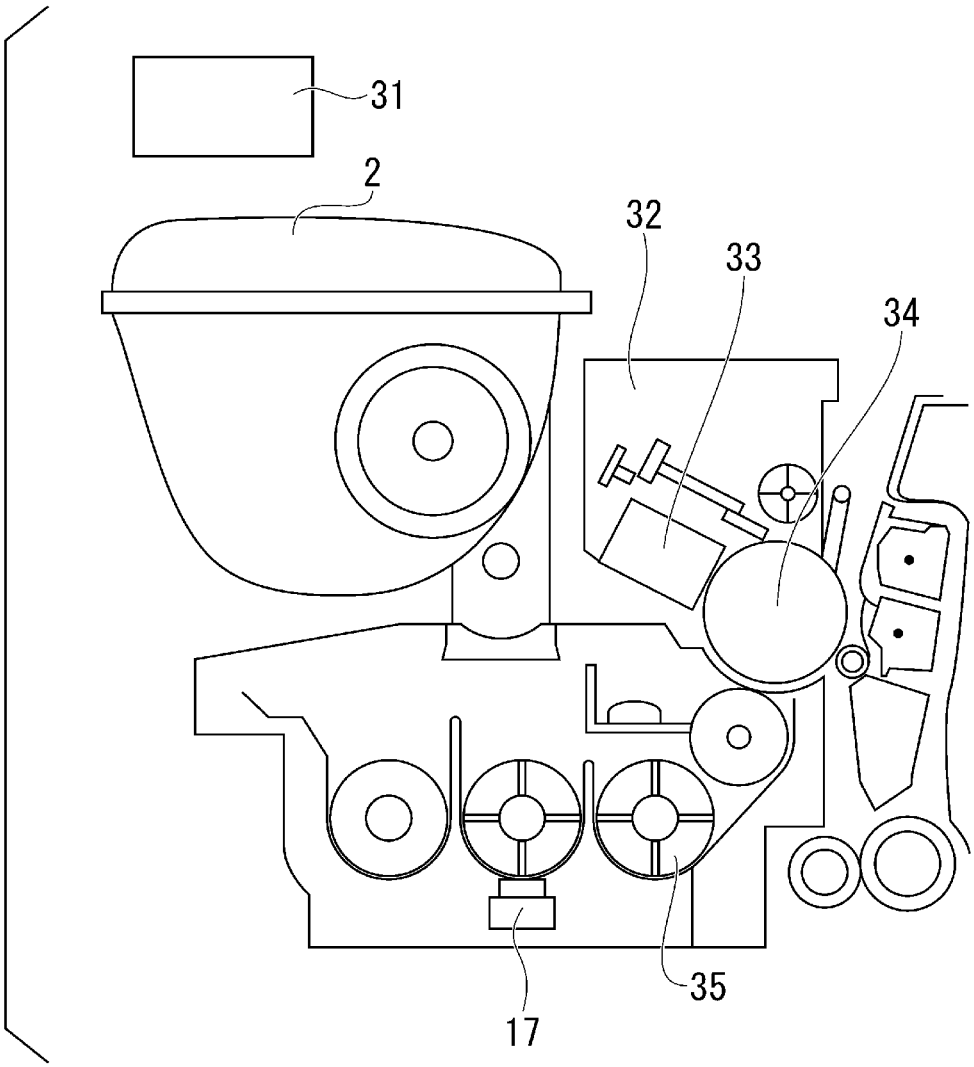
FIG. 2 is a view illustrating a configuration example of a portion of an image forming unit.

FIG. 2 is a view illustrating a configuration example of a portion of the image forming unit 130. The image forming unit 130 includes a cartridge 2 (developer cartridge), a sensor 17, a developer supply motor 31 (supplying device), a cleaning unit 32, a charger 33, a photoconductor 34, and a developing device 35.

The sensor 17 outputs a physical quantity (first physical quantity) relating to an amount of toner remaining in the developing device 35 of the image forming apparatus 100. In the following description, the first physical quantity is greater as the amount of toner remaining in the developing device 35 is greater. For example, the sensor 17 may be configured using an automatic toner sensor. In this case, the sensor 17 may be configured to detect density of toner. The sensor 17 may be configured to detect a remaining amount of toner. For example, the sensor 17 may be configured using a sensor that measures magnetic permeability.

The cartridge 2 is configured detachably from the image forming apparatus 100. The cartridge 2 is filled with developer including toner and a carrier. The developer supply motor 31 is a motor that operates when the developer in the cartridge 2 is supplied to the developing device 35. The cleaning unit 32 removes toner attached to the surface of the photoconductor 34. The charger 33 charges the surface of the photoconductor 34. The photoconductor 34 has a surface on which an image is formed with the toner.

Figure 3:
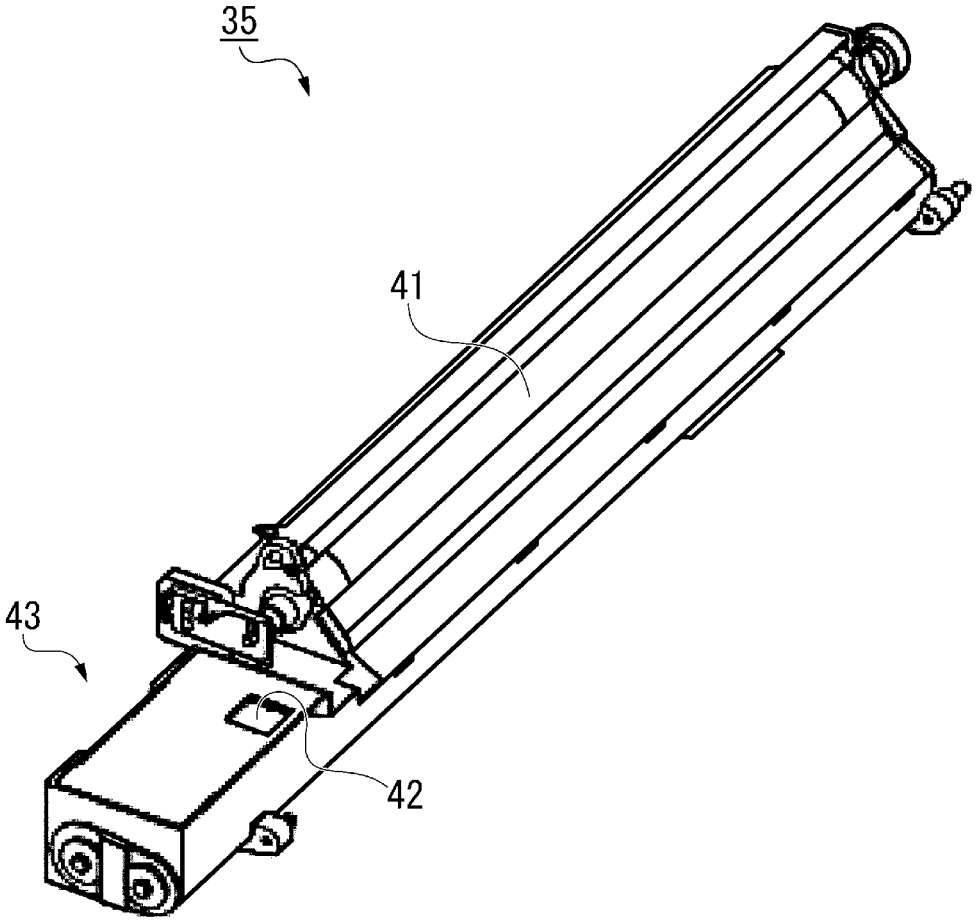
FIG. 3 is a perspective view illustrating an example of the appearance of a developing device.

FIG. 3 is a perspective view illustrating an example of the appearance of the developing device 35. The developing device 35 is configured to be able to store the developer. The developing device 35 includes a developing roller 41, a developer supply port 42, and a developer discharge port 43. The developing device 35 supplies the toner to the photoconductor 34 by the developing roller 41. A predetermined amount of carriers exists in the developing device 35. Charges are generated in the toner by stirring the toner and the carrier. The amount of the carriers existing in the developing device 35 is almost constant. Therefore, when the amount of the toner in the developing device 35 is large, the amount of the carrier is relatively small. Meanwhile, when the amount of the toner in the developing device 35 is small, the amount of the carrier is relatively large. In this manner, the physical quantity such as magnetic permeability changes depending on the amount of the toner in the developing device 35. The sensor 17 detects the amount of the toner in the developing device 35 based on the physical quantity that changes in this manner.

When the developer supply motor 31 is driven, the developer in the cartridge 2 moves to the developing device 35 via the developer supply port 42. The toner included in the developer that moved to the developing device 35 is attached to an electrostatic latent image of the photoconductor 34 when an image is formed. The visible image is formed by the attachment of the toner. When the toner in the developing device 35 is used to form an image, the amount of the toner in the developing device 35 gradually decreases. The amount of the toner in the developing device 35 is detected based on the output of the sensor 17. If it is determined that the amount of the toner in the developing device 35 is less than the lower threshold value, the developer supply motor 31 is driven until the amount becomes the upper threshold value or more. Due to the driving of the developer supply motor 31, the developer in the cartridge 2 moves into the developing device 35.

When the developer moves into the developing device 35, the developer in the developing device 35 overflows. The overflowing developer is discharged to the outside of the developing device 35 via the developer discharge port 43. In this manner, due to the overflow of the developer, the amount of the developer in the developing device 35 is maintained constant, and the carrier deteriorating in the developing device 35 is discharged to the outside. In the developing device 35, a new carrier is supplied as developer, and as a result, the carrier in the developing device 35 is gradually replaced with the new carrier. The replacement of the developer in the developing device 35 is performed per developing device 35 corresponding to each toner.

Figure 4:
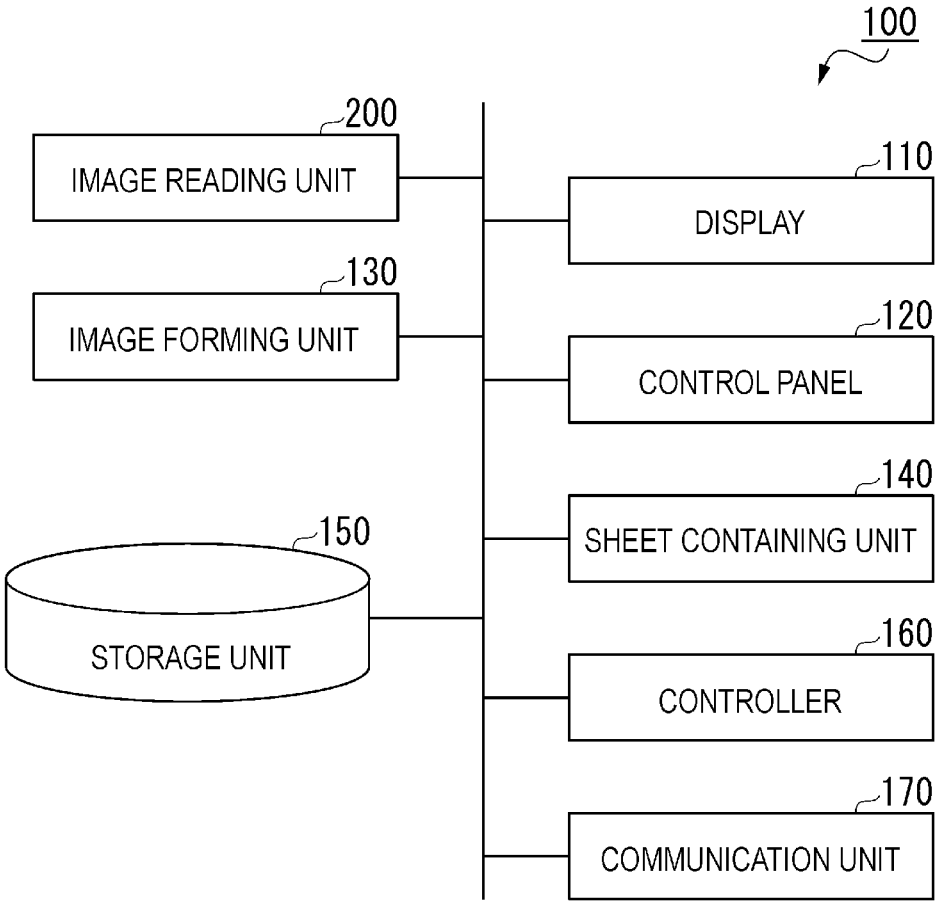
FIG. 4 is a hardware block diagram of the apparatus.

FIG. 4 is a hardware block diagram of the image forming apparatus 100 according to the exemplary embodiment. The image forming apparatus 100 includes the image reading unit 200, the display 110, the control panel 120, the image forming unit 130, the sheet containing unit 140, a storage unit 150, the controller 160, and a communication unit 170. Among this hardware, the image reading unit 200, the display 110, the control panel 120, the image forming unit 130, and the sheet containing unit 140 are described above, and thus the descriptions thereof are omitted.

The storage unit 150 is configured using a storage device such as a magnetic hard disk device or a semiconductor storage device. The storage unit 150 stores data required when the image forming apparatus 100 operates. For example, the storage unit 150 may store data of a program executed by the controller 160. For example, the storage unit 150 may temporarily store image data to be formed in the image forming apparatus 100. For example, the storage unit 150 may store image data generated by the image reading unit 200. For example, the storage unit 150 may store information indicating a condition of the determination performed by the controller 160 or the value of a counter.

The controller 160 is configured using a processor such as a central processing unit (CPU) and a memory. The controller 160 reads out and executes a program stored in the storage unit 150 in advance. The controller 160 controls an operation of each device included in the image forming apparatus 100. The controller 160 controls the driving of the developer supply motor 31 based on the physical quantity output from the sensor 17. For example, if the physical quantity output from the sensor 17 indicates a decrease of the toner density, the controller 160 supplies the developer to the developing device 35 by driving the developer supply motor 31. The controller 160 performs estimation with respect to the deterioration of the developer in the developing device 35.

The communication unit 170 is a communication interface that performs data communication with another device according to a predetermined communication protocol.

Next, the processing of the controller 160 is specifically described. The controller 160 acquires information (hereinafter, referred to as "stirring cumulative information") relating to a cumulative value of time for which the developer is stirred in the developing device 35 of the image forming apparatus 100. The controller 160 acquires information (hereinafter, referred to as "supply cumulative information") relating to a cumulative value of the developer supplied to the developing device 35. The controller 160 acquires the stirring cumulative information and the supply cumulative information for each developing device 35. For example, if the developing devices 35 are provided respectively for yellow (Y), magenta (M), cyan (C), and black (K), the controller 160 acquires the stirring cumulative information and the supply cumulative information for each color. The controller 160 estimates the degree of deterioration of the developer in the developing device 35 for each developing device 35 based on the stirring cumulative information and the supply cumulative information. For example, the controller 160 may estimate the degree of deterioration by acquiring an index value (hereinafter, referred to as a "deterioration index") indicating the degree of deterioration of the developer in the developing device 35.

The controller 160 may acquire a cumulative value (hereinafter, referred to as a "print number counting value") of the number of printed sheets in the image forming apparatus 100, as a specific example of the stirring cumulative information. As a specific example of the stirring cumulative information, the controller 160 may acquire a cumulative value (hereinafter, referred to as a "developing device counting value") of the driving time of the developing device 35. For example, the developing device counting value may be acquired by counting up one every two seconds while the developing device 35 is driven.

The controller 160 may acquire a cumulative value (hereinafter, referred to as a "supply motor counting value") of the driving time of the developer supply motor 31, as a specific example of the supply cumulative information. For example, the supply motor counting value may be acquired by counting up one every 12 seconds while the developer supply motor 31 is driven. The controller 160 may acquire a cumulative value of values obtained by multiplying a printing rate and the number of printed sheets as a specific example of the supply cumulative information. The controller 160 may acquire a cumulative value of the number of print pixels as a specific example of the supply cumulative information.

Hereinafter, processing when the controller 160 uses the developing device counting value as the stirring cumulative information and uses the supply motor counting value as the supply cumulative information will be described as a specific example.

The controller 160 records the developing device counting value and the supply motor counting value in the storage unit 150. The controller 160 updates each counting value thereof at a predetermined update timing. The update timing may be a timing after a print job is executed, for example. The controller 160 updates each counting value thereof to zero by initialization at a predetermined initialization timing (initialization). For example, the initialization timing is a timing at which the developer is supplied to the developing device 35 for the first time, a timing at which the developer is replaced, or a timing at which an initial operation (for example, toner density adjusting operation) is executed after the replacement of the developer. The initialization timing may be automatically determined as a timing at which the replacement of the developer is detected by a sensor or the like which is provided in the developing device 35. The initialization timing may be manually instructed by a person who replaces the developer of the developing device 35.

The controller 160 may calculate a deterioration index, for example, based on the following expression.

$$\text{Current deterioration index}=(\text{Previous deterioration index}+A)\times(1-B)\times 100$$

A=(Current developing device counting value−previous developing device counting value)/developing device counting reference value B=(Current supply motor counting value−previous supply motor counting value)/supply motor counting reference value In the above expression, the developing device counting reference value refers to a driving time counting value of the developing device 35 which is required for printing, until the performance of the developer reaches a replacement level without supplying the carrier. The supply motor counting reference value refers to a supplying time counting value of the cartridge 2 which is required for supplying the developer for one capacity unit of the developing device 35 to the developing device 35. The current deterioration index is the latest deterioration index calculated newly, and the previous deterioration index is a deterioration index that is calculated in the immediately preceding processing. The current developing device counting value is the latest developing device counting value, and the previous developing device counting value is a developing device counting value acquired in the immediately preceding processing. The current supply motor counting value is the latest supply motor counting value, and the previous supply motor counting value is a supply motor counting value acquired in the immediately preceding processing.

The value of A calculated in this manner is a value referring to a rate at which the developer deteriorates between the end of the previous print job and the end of the current print job. The value of B calculated in this manner refers to a rate at which the developer is replaced (refreshed) with new developer between the end of the previous print job and the end of the current print job. The driving of the developing device 35 in the present exemplary embodiment is not so-called continuous printing, but a value in an operation mode (so-called an intermittent operation) in which printing is performed for each a predetermined number of sheets (for example, five sheets), stopped, and is restarted.

The first half "previous deterioration index+A" on the right side of the expression for calculating the current deterioration index refers to a rate at which the developer is stirred and deteriorates in the developing device 35 in the current print job. The latter half "1−B" on the right side refers to a rate at which the developer is not replaced (not refreshed) but remains in the developing device 35, though new developer is supplied to the developing device 35 in the current print job. The state of deterioration of the developer stored in the developing device 35 can be estimated by multiplying the first half by the latter half of the above-mentioned expression.

Figure 5:
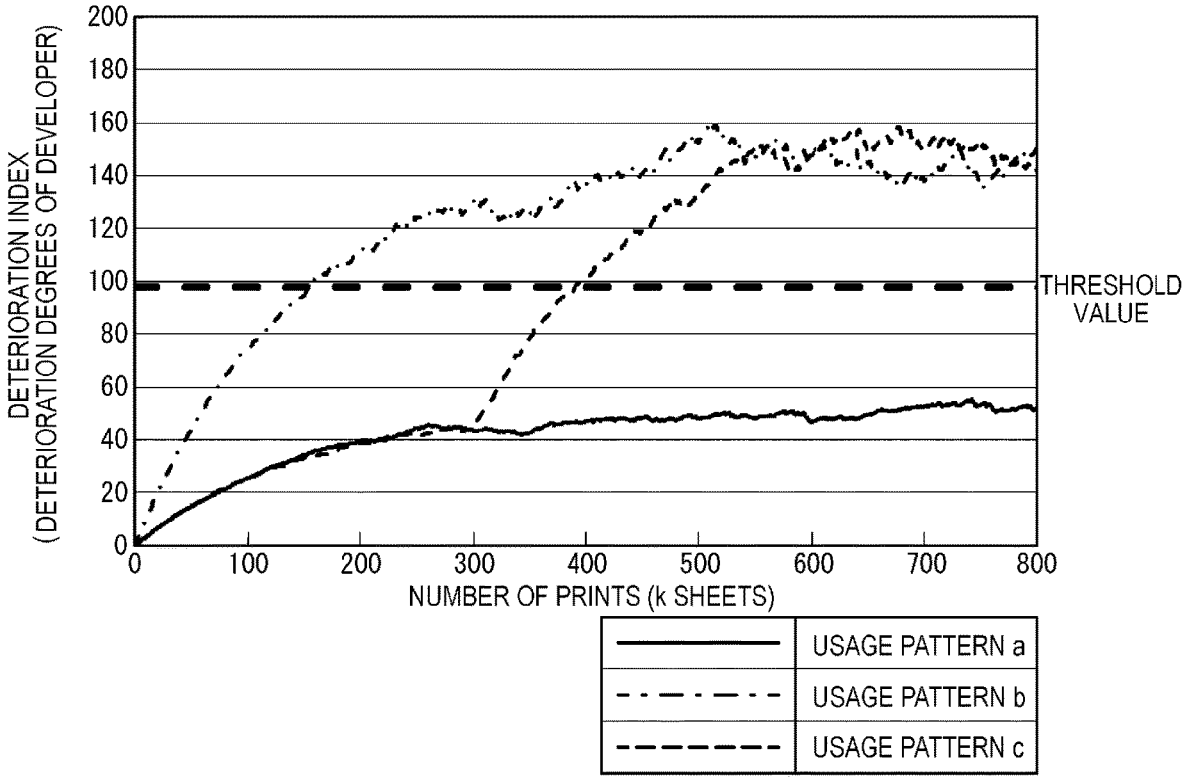
FIG. 5 is a diagram illustrating a specific example of history of a deterioration index.

The controller 160 may determine the necessity for the replacement of the developer based on the history of the deterioration index. Specific examples of the determination are described. FIG. 5 is a diagram illustrating a specific example of the history of the deterioration index. The lateral axis indicates the number of printed sheets. The vertical axis indicates a deterioration index, and the value of "100" is a threshold value. The deterioration index exceeding the threshold value indicates that the deterioration of the developer in the developing device 35 proceeds, and the replacement is highly likely to be recommended.

For example, in a usage pattern a in which a large number of prints with an average printing rate of 10% or more are performed, the carrier is frequently replaced. Therefore, the deterioration index is maintained to be low, and the deterioration index does not exceed the threshold value. Meanwhile, in a usage pattern b in which most prints have an average printing rate of about 1%, since the carrier is hardly replaced, the deterioration index gradually increases, and the deterioration index exceeds the threshold value in the prints of about 150K sheets. In a usage pattern c, even though prints have an average printing rate of 10% or more up to about 300K sheets, the average printing rate decreases to about 1% thereafter. Therefore, after the prints of about 300K sheets, the deterioration index gradually increases, and the deterioration index exceeds the threshold value in the prints of about 400K sheets.

Even in each of the usage patterns, the controller 160 may estimate the following matters based on the history of the deterioration index up to the present. Also, the controller 160 may output an estimation result.

At this point, whether the deterioration progresses to the degree in which the developer needs to be replaced (replacement necessity)

Timing at which the deterioration progresses to the degree in which the developer needs to be replaced (replacement timing)

When determining the replacement necessity, the controller 160 may calculate a deterioration progress index and perform determination based on the deterioration index and the deterioration progress index. The deterioration progress index is an index indicating a temporal change of the deterioration of the developer. For example, the deterioration progress index may be a statistical value (for example, a maximum value) of a value (for example, a differential value) indicating the amount of the change of the deterioration index for a predetermined period of time from the present to the past, or may be another value. The controller 160 determines that the developer needs to be replaced when the deterioration index exceeds the threshold value, and the deterioration progress index is a value indicating that there is no predetermined drastic change for the predetermined period of time (for example, past one week from the present). These two conditions are collectively referred to as deterioration conditions. Meanwhile, the controller 160 determines that the developer does not need to be replaced even if the deterioration index exceeds the threshold value, when the deterioration progress index is a value indicating that there is a predetermined drastic change for the predetermined period of time.

Figure 6:
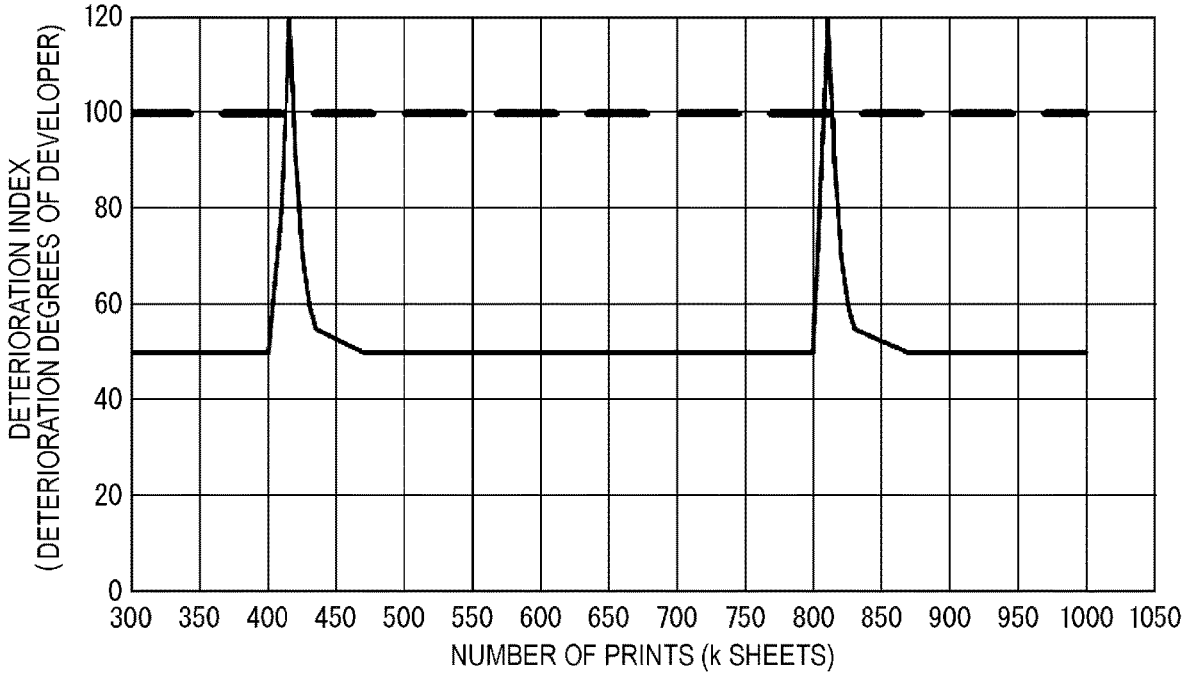
FIG. 6 is a diagram illustrating an example of a change in a deterioration index in a usage pattern d.

The reason that such a determination is made is described with reference to FIG. 6. FIG. 6 is a diagram illustrating an example of a change in the deterioration index in a usage pattern d. In the usage pattern d, printing with an average printing rate of 10% or more is performed in most printing, but printing with an extremely low average printing rate (for example, about 0.5%) is performed for a certain short period of time. Therefore, a value of the deterioration index drastically deteriorates in a specific short period of time and exceeds the threshold value in some cases. However, if the specific short period of time ends, printing with a high average printing rate restarts. Therefore, if the specific short period of time ends, the deterioration index drastically improves. Therefore, even if the deterioration index temporarily exceeds the threshold value, the developer does not need to be replaced, and the deterioration index naturally improves. In this usage pattern d, the deterioration progress index indicates that there is a predetermined drastic change for a predetermined period of time. Therefore, if the deterioration progress index is such a value, it is determined that the developer does not need to be replaced.

The output destination of the estimation result may be the display 110 of the image forming apparatus 100, may be an information processing device (for example, a personal computer or a smartphone) of a user of the image forming apparatus 100, or may be an information processing device (for example, a personal computer or a smartphone) of a maintenance person of the image forming apparatus 100. When the estimation result is output to another device, information is transmitted via the communication unit 170. By referring to such an estimation result, for example, a maintenance person can replace the developer at a proper timing. Also, in the usage pattern in which an average printing rate changes in the middle like the usage pattern c, the maintenance person can replace the developer at a proper timing.

Figure 7:
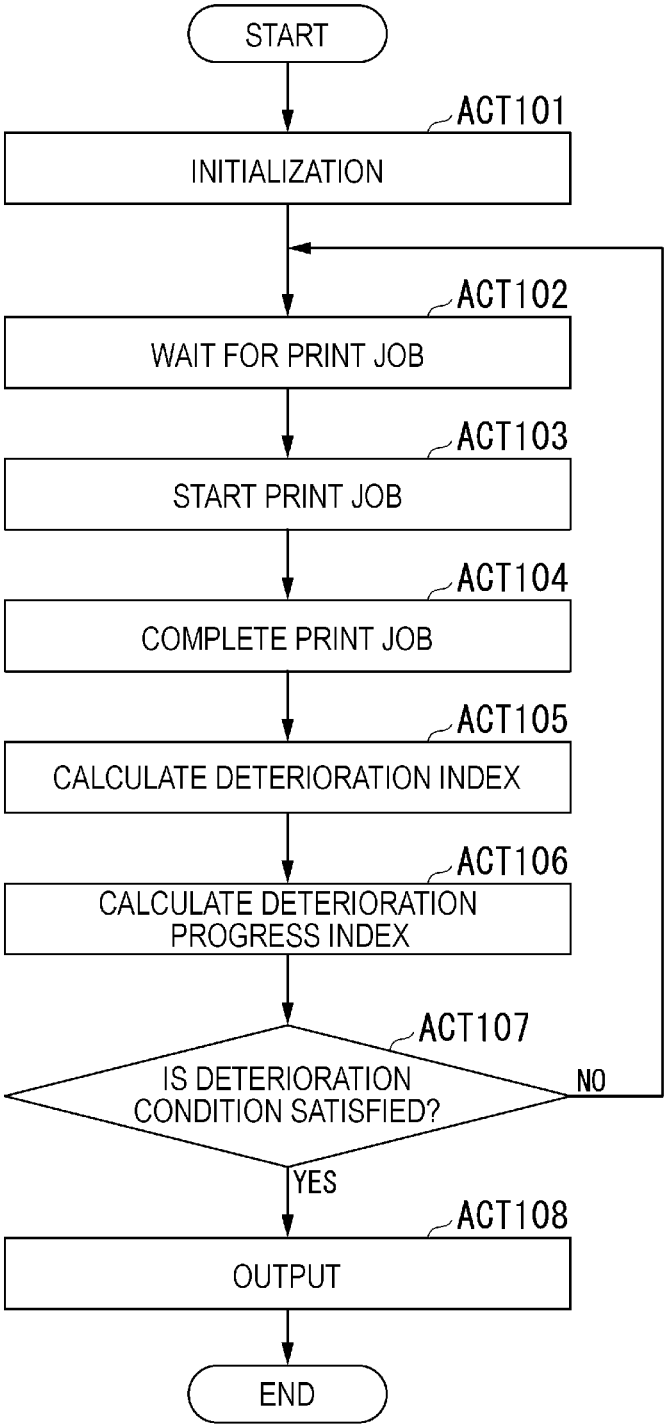
FIG. 7 is a flowchart illustrating a specific example of the operation of the apparatus.

FIG. 7 is a flowchart illustrating a specific example of the operation of the image forming apparatus 100. First, the controller 160 executes initialization (ACT 101). Next, the controller 160 transitions to a state of waiting for a print job (ACT 102). Thereafter, when the print job is input, the controller 160 starts the print job (ACT 103). If the print job is completed (ACT 104), the controller 160 acquires each counting value at the time point and calculates a deterioration index (ACT 105). The controller 160 calculates a deterioration progress index based on the history of the deterioration index up to the time point (ACT 106). The controller 160 determines whether the deterioration condition is satisfied based on the calculated deterioration index and the calculated deterioration progress index (ACT 107). If the deterioration condition is not satisfied (ACT 107—NO), the controller 160 returns to the processing of ACT 102. Meanwhile, if the deterioration condition is satisfied (ACT 107—YES), the controller 160 outputs that the deterioration condition is satisfied (ACT 108).

According to the image forming apparatus 100 configured as above, the timing for the replacement in accordance with the deterioration of the developer in the developing device 35 is determined based on the history of the deterioration. Therefore, the determination can be accurately performed, for example, even if there are various usage patterns as in FIG. 5. For example, even if the deterioration index extremely deteriorates temporarily and exceeds the threshold value as in FIG. 6, when improvement is expected thereafter according to the history so far, it is determined that it is not the timing for the replacement. Therefore, unnecessary replacement of the developer can be prevented.

The controller 160 may display the history of the deterioration index as illustrated in FIG. 5, on the display 110. In this case, among the graphs illustrated with three kinds of lines, any one actual graph may be displayed.

Figure 8:
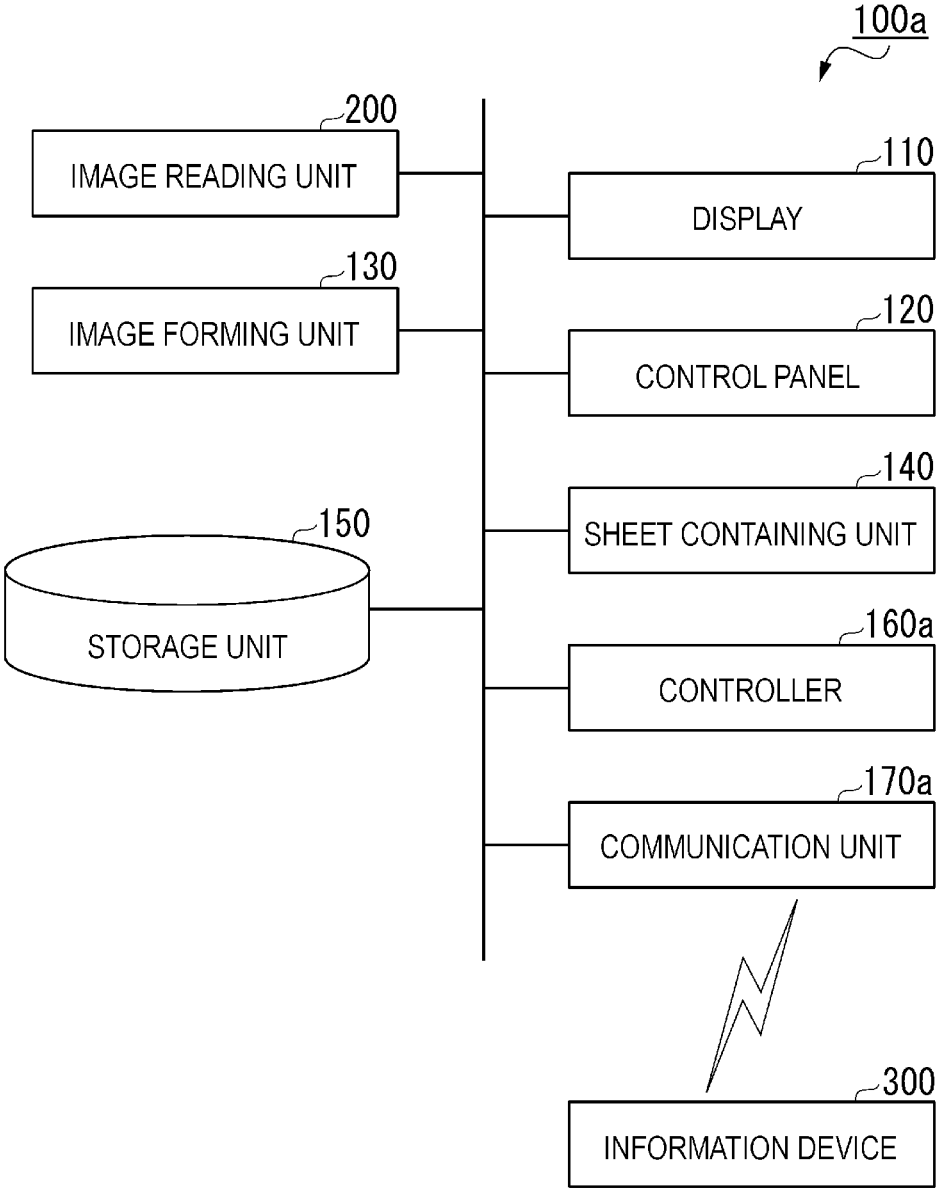
FIG. 8 is a hardware block diagram of an image forming apparatus according to a modification example.

FIG. 8 is a hardware block diagram of an image forming apparatus 100*a* according to a modification example of the exemplary embodiment. In the modification example, the image forming apparatus 100*a* includes a controller 160*a* and a communication unit 170*a* instead of the controller 160 and the communication unit 170. The controller 160*a* communicates with an information device 300 via the communication unit 170*a*. For example, the controller 160*a* may transmit each counting value to the information device 300 via the communication unit 170*a*. In this case, instead of the controller 160*a*, the information device 300 may calculate the deterioration index, record the history of the deterioration index, and calculate the deterioration progress index. In this case, the information device 300 may display the deterioration index, the history of the deterioration index, the deterioration progress index, the determination results, and the like, to a user or a maintenance person of the image forming apparatus 100*a*.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a developing device that contains developer comprising toner and a carrier and includes a stirrer for stirring the developer;

a developer container that contains developer to be supplied to the developing device; and a controller configured to acquire a deterioration index indicating a degree of deterioration of the developer in the developing device based on stirring cumulative information which is information relating to a cumulative value of time for which the stirrer stirs the developer in the developing device and supply cumulative information indicating information relating to a cumulative value of the developer supplied from the developer container to the developing device, and determine a timing for replacement of the developer based on information on a history of the deterioration index.

2. The image forming apparatus according to claim 1, wherein the controller determines the timing for replacement of the developer based on whether, in the history of the deterioration index, a deterioration progress index indicating an amount of a change of the deterioration index indicates that there is no drastic change in the deterioration index.

3. The image forming apparatus according to claim 2, wherein the controller determines that the timing for replacement of the developer occurs when the deterioration index exceeds a predetermined threshold value and indicates that the developer deteriorates, and the deterioration progress index indicates that there is no predetermined drastic change.

4. The image forming apparatus according to claim 1, comprising a plurality of developing devices, and wherein the controller determines the timing for replacement of the developer for each developing device.

5. The image forming apparatus according to claim 1, wherein the controller acquires a cumulative value of a driving time of the developing device as the stirring cumulative information.

6. The image forming apparatus according to claim 1, wherein the controller acquires a cumulative value of a number of printed sheets in the image forming apparatus as the stirring cumulative information.

7. The image forming apparatus according to claim 1, further comprising:

a supply motor that drives to supply the developer from the developer container to the developing device, wherein the controller acquires a cumulative value of a driving time of the supply motor as the supply cumulative information.

8. The image forming apparatus according to claim 1, wherein the controller calculates the deterioration index using a value obtained by dividing a difference between the stirring cumulative information at present and the stirring cumulative information at a predetermined timing in the past by stirring cumulative information required for printing until performance of the developer deteriorates to a state of replacement without supplying the carrier.

9. The image forming apparatus according to claim 1, wherein the controller calculates the deterioration index using a value obtained by dividing a difference between the supply cumulative information at present and the supply cumulative information at predetermined timing in the past by the supply cumulative information required for supplying developer for one capacity unit of the developing device to the developing device.

10. A determination method performed by an image forming apparatus, comprising:

acquiring stirring cumulative information that is information relating to a cumulative value of time for which a stirrer stirs developer in a developing device;

acquiring supply cumulative information that indicates information relating to a cumulative value of the developer supplied from a developer container to the developing device;

acquiring a deterioration index indicating a degree of deterioration of the developer in the developing device based on the stirring cumulative information and the supply cumulative information; and determining a timing for replacement of the developer based on information on a history of the deterioration index.

11. The determination method according to claim 10, further comprising:

determining the timing for replacement of the developer based on whether, in the history of the deterioration index, a deterioration progress index indicating an amount of a change of the deterioration index indicates that there is no drastic change in the deterioration index.

12. The determination method according to claim 11, further comprising:

determining that the timing for replacement of the developer occurs when the deterioration index exceeds a predetermined threshold value and indicates that the developer deteriorates, and the deterioration progress index indicates that there is no predetermined drastic change.

13. The determination method according to claim 10, wherein the image forming apparatus comprises a plurality of developing devices, the determination method further comprising:

determining the timing for replacement of the developer for each developing device.

14. The determination method according to claim 10, further comprising:

acquiring a cumulative value of a driving time of the developing device as the stirring cumulative information.

15. The determination method according to claim 10, further comprising:

acquiring a cumulative value of a number of printed sheets in the image forming apparatus as the stirring cumulative information.

16. The determination method according to claim 10, further comprising:

driving a supply motor to supply the developer from the developer container to the developing device, and acquiring a cumulative value of a driving time of the supply motor as the supply cumulative information.

17. The determination method according to claim 10, further comprising:

calculating the deterioration index using a value obtained by dividing a difference between the stirring cumulative information at present and the stirring cumulative information at a predetermined timing in the past by stirring cumulative information required for printing until performance of the developer deteriorates to a state of replacement without supplying the carrier.

18. The determination method according to claim 10, further comprising:

calculating the deterioration index using a value obtained by dividing a difference between the supply cumulative information at present and the supply cumulative information at predetermined timing in the past by the supply cumulative information required for supplying developer for one capacity unit of the developing device to the developing device.

19. A developer processing apparatus, comprising:

a developing device that contains developer and a stirrer for stirring the developer;

a developer container that contains developer to be supplied to the developing device; and a controller configured to acquire a deterioration index indicating a degree of deterioration of the developer in the developing device based on stirring cumulative information which is information relating to a cumulative value of time for which the stirrer stirs the developer in the developing device and supply cumulative information indicating information relating to a cumulative value of the developer supplied from the developer container to the developing device, and determine a timing for replacement of the developer based on information on a history of the deterioration index.

20. The developer processing apparatus according to claim 19, wherein the controller determines the timing for replacement of the developer based on whether, in the history of the deterioration index, a deterioration progress index indicating an amount of a change of the deterioration index indicates that there is no drastic change in the deterioration index.

* * * * *